US005379782A

United States Patent [19]

Tabb

[11] Patent Number: 5,379,782

[45] Date of Patent: Jan. 10, 1995

[54] HAIR FASHION ACCESSORY

[76] Inventor: Birdie B. Tabb, Rte. 10, Box. 350, Tallahassee, Fla. 32310

[21] Appl. No.: 133,587

[22] Filed: Oct. 8, 1993

[51] Int. Cl.[6] ..... A45D 8/24; A45D 8/14

[52] U.S. Cl. ..... 132/275; 132/273; 28/41; 2/174

[58] Field of Search ..... 132/148, 219, 273, 275, 132/276, 278, 279; 2/174; D28/41, 42

[56] References Cited

U.S. PATENT DOCUMENTS

| | | | |
|---|---|---|---|
| D. 292,030 | 9/1987 | Reuson | D28/41 |
| D. 315,036 | 2/1991 | Leopold | D28/41 |
| 4,998,186 | 3/1991 | Cocca | 132/275 |
| 5,044,385 | 9/1991 | Rhodes | 132/273 |
| 5,154,196 | 10/1992 | Moffat | 132/275 |
| 5,156,171 | 10/1992 | Goodman | 132/273 |
| 5,301,696 | 4/1994 | Reuson | 132/273 |

*Primary Examiner*—John G. Weiss
*Attorney, Agent, or Firm*—Peter Loffler

[57] ABSTRACT

An improved hair fashion accessory is disclosed. The invention consists of two long strips of material being formed into hollow tubes. The tubes are interlaced with one another. The ends of the tubes are attached to form a ring. An elastic band is disposed within the internal circumference thereby forming a hair twistee. Alternate embodiments of the invention, including a puffy hair attachment accessory, a dual color hair comb, and a twistee with an inner circumference free of material, are also disclosed.

14 Claims, 4 Drawing Sheets

HAIR FASHION ACCESSORY

BACKGROUND AND SUMMARY OF THE INVENTION

A multitude of fashion accessories are available for women to assist in hair styling. Hair clips, ribbons, bows, headbands, barrettes, elastic bands, and the like are common devices stockpiled by individuals with long hair. The accessories typically come in a plethora of colors and designs and are used for style as well as hair control.

Recently, pony tail holders, commonly known as hair twistees, have become very fashionable. These devices take a strand of material and form it into a hollow tube. Disposed within the hollow tube is an elastic band. The tube of material and internal band are then connected at their two respective ends to form a circular ring. The wearer's hair is pulled through the ring and the elastic band constricts around the hair to remain in place. The material tube is longer than the elastic band so that when the ring is formed, the material will bunch up at several points around the ring creating a puffy effect.

Many wearers of these twistees will also wear them as a bracelets.

Available in a variety of colors, these hair twistees are used to accentuate the wearer's wardrobe. This variety of colors is not without limits though. The circular tube is formed from one continuous strip of material. Therefore, the use of a solid color material or a plaid is relatively straightforward. The difficulty arises when a hair twistee comprising two solid colors is attempted.

On Autumn Saturday afternoon and evenings, millions of Americans are either at the stadium or have their eyes glued to the television watching their favorite college team play football. In order to show school spirit and support, fans will wear the school's colors, typically two colors, in an assortment of embodiments such as shirts, shorts, socks, hats, and so on. Some fans also wish to display the school's colors in the hair twistees they wear. Other college sports garner similar spirit.

In order to fabricate the above-described hair twistee in two different solid colors the strip used to form the hollow tube is constructed from two smaller strips of material, one strip in each color. The smaller strips are joined together at one of their long edges to form the larger strip from which the hollow tube is them constructed. This approach produces a reasonably appealing hair twistee. However, the twistee so produced, has a modular and somewhat contrived appearance. The two different colors do not cross-over or blend with one another and therefore appear, as they do, that the colors are each from a different piece of material. Furthermore, when such a twistee is worn, one color will be dominant over the other, producing an uneven appearance.

The above problems are further amplified when a third or subsequent color is introduced such as a red, white, and blue patriotic Forth of July twistee.

The present invention overcomes the above twistee shortcomings by producing a multi-colored twistee that has a seamless appearance where no one color predominates over any other, when worn.

The present invention is produced by taking two long strips of material and forming each one into a hollow tube. The tubes are then interlaced over one another.

The tubes so interlaced produce a synergistic spectral effect of the two colors that is visually appealing. The ends of the tubes can then be attached to form a circular ring. Within the internal circumference of the ring an elastic band can be disposed to form a hair twistee. When worn, the twistee has a rich seamless striped appearance with neither color predominating over the other. More than two colors can be used without any loss in appearance or effect.

A secondary benefit of such a twistee is that it has a fuller and puffier appearance than the twistee described earlier. Even if only one color of material is used to construct the present invention, the twistee so produced will be substantially richer and puffier in appearance than the earlier described twistee.

Furthermore, the hair twistee of the present invention is substantially more versatile in that it can used in varying embodiments so produce a whole set of hair and other fashion accessories.

One such embodiment is to produce a puffy dual colored barrette. After the above circular ring is formed, the ring can be collapsed. This flattened ring can then be attached to a standard hair barrette to produce a puffy hair attachment device that has the dual spectral color appearance.

Another embodiment of the present invention is produced by taking the interlaced tubes and attaching them to a standard hair comb. This produces yet another hair attachment device with the dual spectral color appearance.

A further embodiment of the present invention is produced by specifically locating the elastic band of the above twistee at the far inner circumference of the circular ring. This will produce a twistee wherein the inner side of the elastic is free from material. When the elastic is so disposed, a more comfortable fit is experienced when the twistee removed from the hair and is used as a bracelet.

Other embodiments include attaching the present invention to a banana clip to produce a different type of pony tail holder. The present invention can also be attached to a clip to produce an eye appealing broach. Other fashion accessories are also possible.

Therefore it is an object of the present invention to produce a hair fashion accessory that can be produced in two or more colors wherein the colors are blended and interlaced with one another.

It is another object of the present invention to produce a hair fashion accessory that can be produced in two or more colors wherein neither color predominates over the other when the accessory is worn.

It is another object of the present invention to produce a hair fashion accessory that can be produced in a single color to create a hair fashion accessory that is rich and full in texture and appearance.

It is another object of the present invention to produce a hair fashion accessory that can be produced as a broach.

It is another object of the present invention to produce a hair fashion accessory that can be worn as a twistee, barrette, hair comb, banana clip, or a comfortable bracelet.

It is a final object of the present invention to produce a hair fashion accessory that is inexpensive to produce, that is produced from only readily available materials, and that is produced using conventional methods of manufacture.

DESCRIPTION OF THE PRIOR ART

U.S. Pat. Des. No. 315,036 issued to Leopold discloses a hairband.

U.S. Pat. Des. No. 292,030 issued to Revson discloses an ornamental hairband or similar article.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
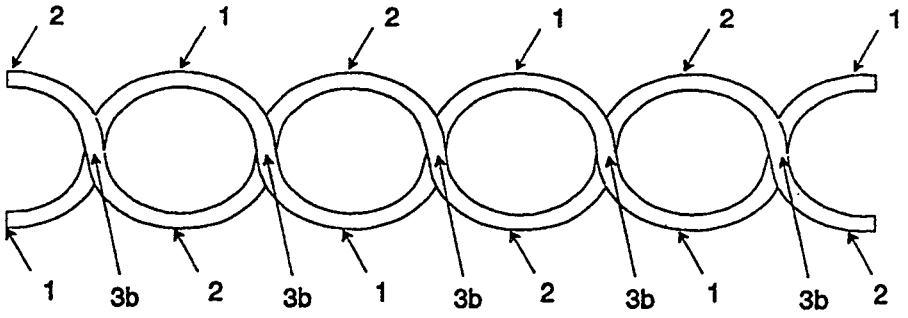
FIG. 1 is a side view of two elongated fabric tubes interlaced in accordance with the present invention.

Referring now to the drawings, FIG. 1 represents a side view of two elongated fabric tubes 1 and 2, respectively. The fabric tubes 1, 2 can be constructed from a variety of conventional materials or fabrics such as acetate, crepe, faille, satin, taffeta, lace, jersey, acrylic, nylon, polyester, rayon, spandex, linen, cotton, ramie, denim or the like.

Each elongated tube is formed from material by cutting the material into a rectangular strip. The rectangular strip of material has a right side and a wrong side. The rectangular strip also includes a length having two long edges and a width having two short edges. The material is folded in half along its length so that the two long edges are in contact, with the right sides of the material facing each other. The two long edges are permanently secured to one another by an attachment means in order to form a seam. This forms a hollow tube.

The hollow tube is then inverted to provide for the right side to be exposed. The hollow tube is flattened and pressed to form a rectangle wherein the seam is located in the center of the rectangle. This forms the elongated fabric tube of the present invention. The seam of the elongated fabric tube always faces the hair securement device so that it is not visible.

The elongated fabric tubes 1 and 2 are interlaced with each other. As illustrated in FIG. 1, elongated fabric tube 2 crosses over elongated fabric tube 1 at point 3*a*. Next elongated fabric tube 1 crosses over elongated fabric tube 2 at point 3*b*. This process is continued until the elongated fabric tubes 1, 2 cover the hair securement device (not illustrated in this figure). The interlacing process forms individual loops that have an eye appealing appearance.

Figure 2:
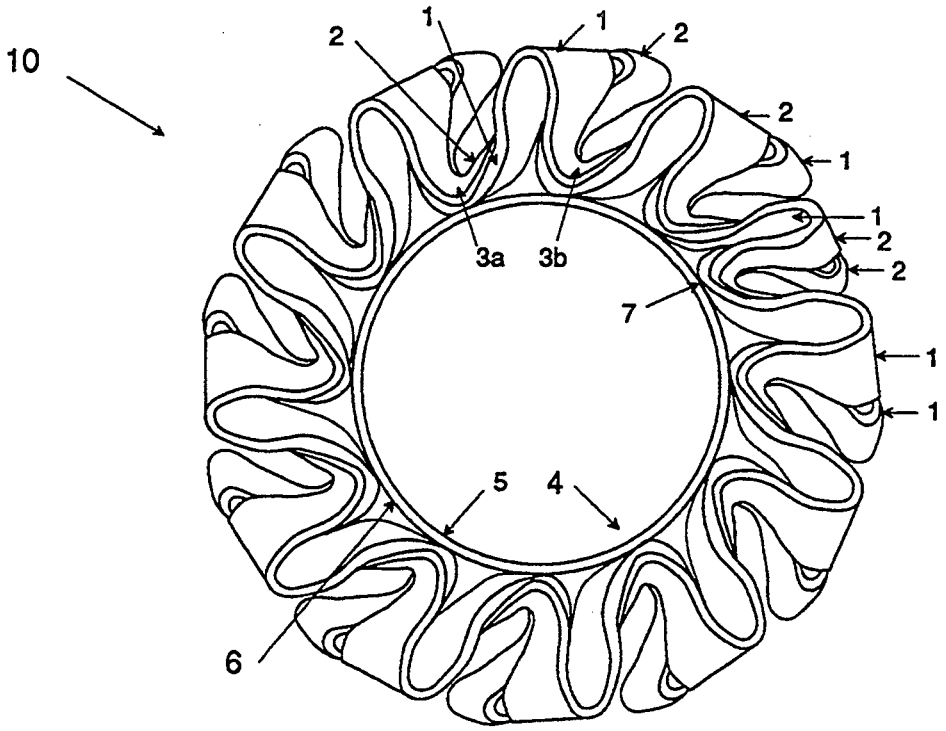
FIG. 2 is a side view of two elongated fabric tubes interlaced and attached to the upper circumference of an elastic band forming the first embodiment of the present invention.

FIG. 2 illustrates a side view of two elongated fabric tubes 1, 2 which are interlaced and secured to an elastic band 4 to form a ponytail holder 10. The elastic band 4 is formed into a ring which has an inner circumference 5 and an outer circumference 6. The elongated fabric tube 2 crosses over elongated fabric tube 1 at point 3*a*. Next, elongated fabric tube 1 crosses over elongated fabric tube 2 at point 3*b*. This process is continued until the elongated fabric tubes 1, 2 cover the elastic band 4. Securement of the elongated fabric tubes 1, 2 is made at point 7 to the outer circumference 6 of the elastic band 4 by an attachment means. This means of attachment forms a plurality of loops formed by elongated fabric tubes 1, 2.

This pony tail holder 10 is not limited to hair use, but can also be use as a decorative wrist band. This is because the attachment is provided on the outer circumference 6 of the elastic band 4, leaving the inner circumference 5, that circumference to which the wearer's wrist is exposed, free from irritating material or fabric pieces.

Figure 3A:
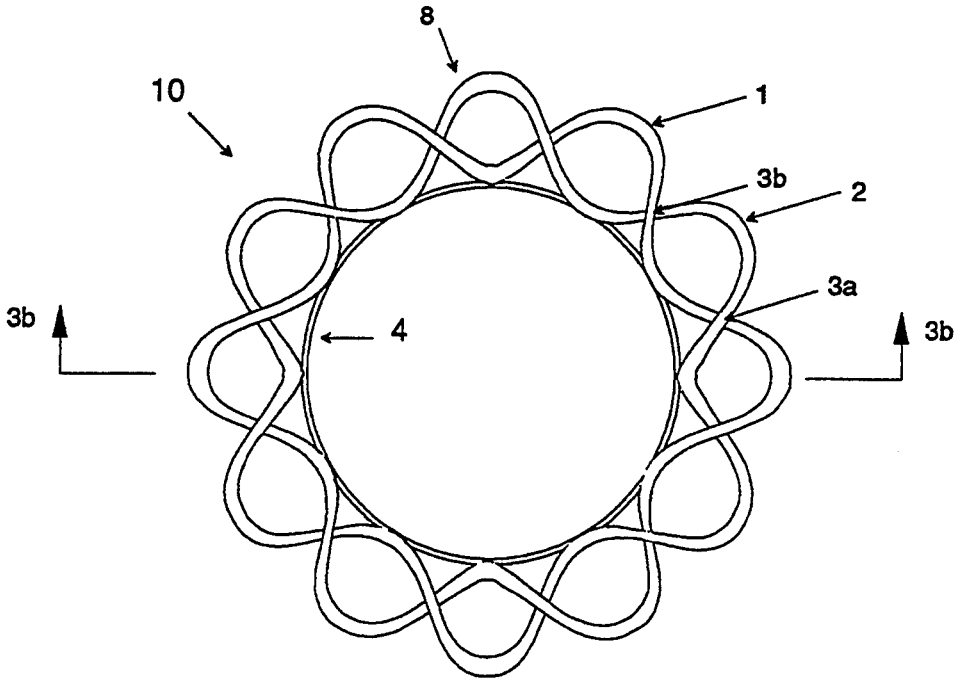
FIG. 3*a* is a side view of two elongated fabric tubes interlaced around an elastic band forming the second embodiment of the present invention.
Figure 3B:
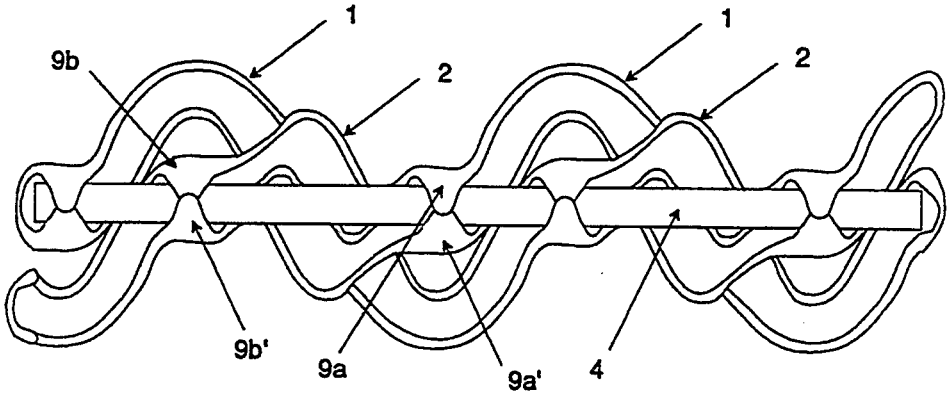
FIG. 3*b* is a portion of the bottom view of the two elongated fabric tubes interlaced around an elastic band taken along line 3*b*—3*b* of FIG. 3*a*.

FIGS. 3*a*and 3*b* illustrates a side view of a second embodiment of a ponytail holder 10 in accordance with the present invention. In this figure, the two elongated fabric tubes 1 and 2 are wrapped around the elastic band 4 to form a fuller looking ponytail holder 10. As illustrated, the elongated fabric tube 2 crosses over elongated fabric tube 1 at point 3*a*. Next, elongated fabric tube 1 crosses over elongated fabric tube 2 at point 3*b*. This process is continued until elongated fabric tubes 1, 2, cover the elastic band 4.

Elongated fabric tube 1 has two edges 9*a* and 9*a*'. The two edges 9*a*, 9*a*' are bought around the elastic band 4 and secured together by an attachment means. Elongated fabric tube 2 has two edges 9*b* and 9*b*'. The two edges 9*b*, 9*b*' are bought around the elastic band 4 and secured together by an attachment means 11. The attachment means can occur at a point between the end of the edges 9*a*, 9*a*', 9*b*, 9*b*' up to the mid-portion of each elongated fabric tube in order to obtain various design effects for the loops 8. The loops 8 become less defined and structured when the attachment means is closer to the edge of the elongated fabric tube.

Figure 4:
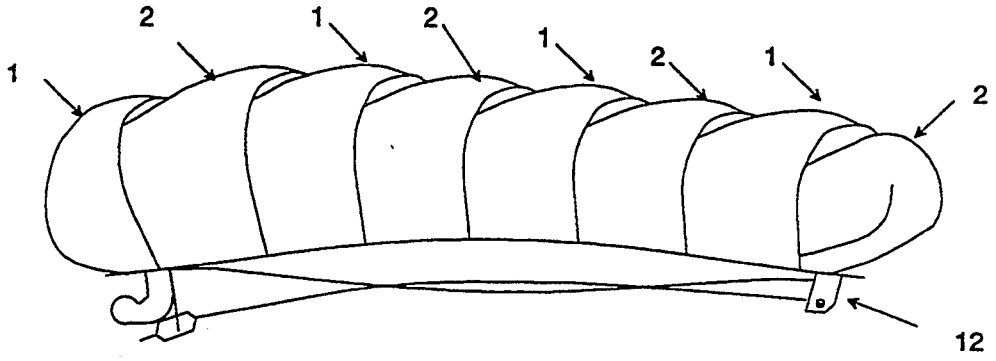
FIG. 4 is a side view of two elongated fabric tubes interlaced and attached to a hair clasp or barrette forming the third embodiment of the present invention.

Once the ponytail holder 10 of FIGS. 2, 3*a*, 3*b* is formed, it can be attached to a hair clasp or barrette to form another embodiment of the present invention illustrated in FIG. 4. In this figure, the ponytail holder 10 is collapsed. The inner circumference of the elastic ring is collapsed to form a straight junction. This straight junction is then secured to a hair clasp or barrette 12 by an attachment means. (not illustrated)

Figure 5:
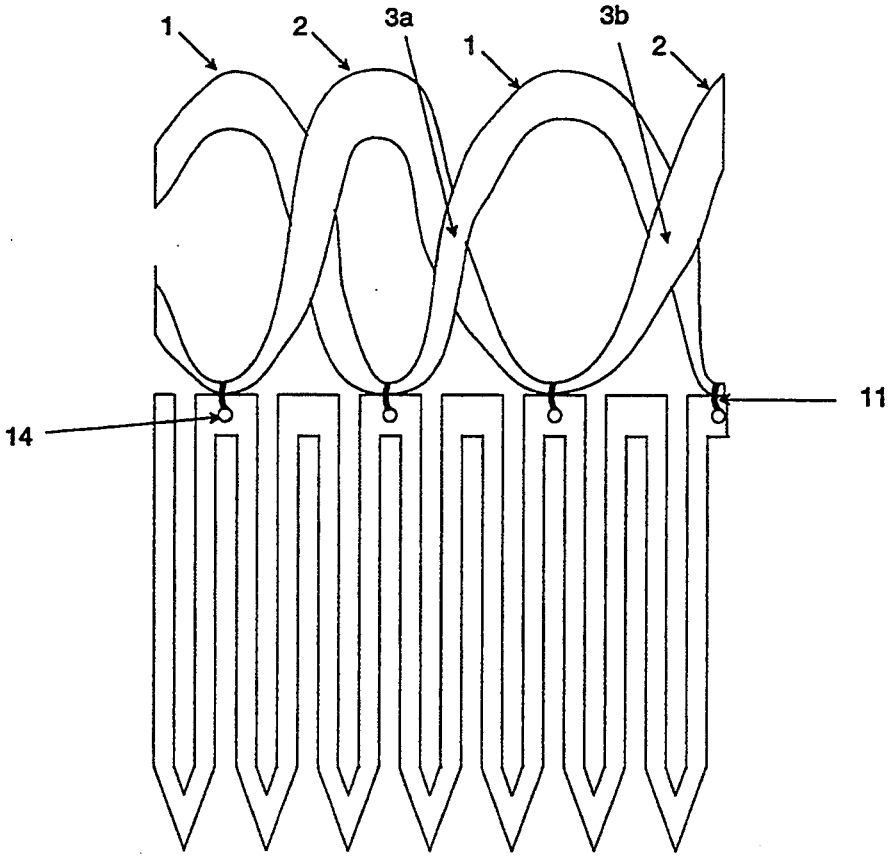
FIG. 5 is a side view of two elongated fabric tubes interlaced and attached to a flexible comb forming the fourth embodiment of the present invention.

FIG. 5 illustrates a partial frontal view of two elongated fabric tubes 1, 2 which are interlaced and secured to a flexible comb 13. The elongated fabric tube 2 crosses over elongated fabric tube 1 at point 3*a*. Next the elongated fabric tube 1 crosses over elongated fabric tube 2 at point 3*b*. This process is continued until the elongated fabric tubes 1, 2 cover the head band 13. Securement of the elongated fabric tubes 1, 2 is made at the top portion of the flexible comb 13 at holes 14 by an attachment means 11.

Figure 6A:
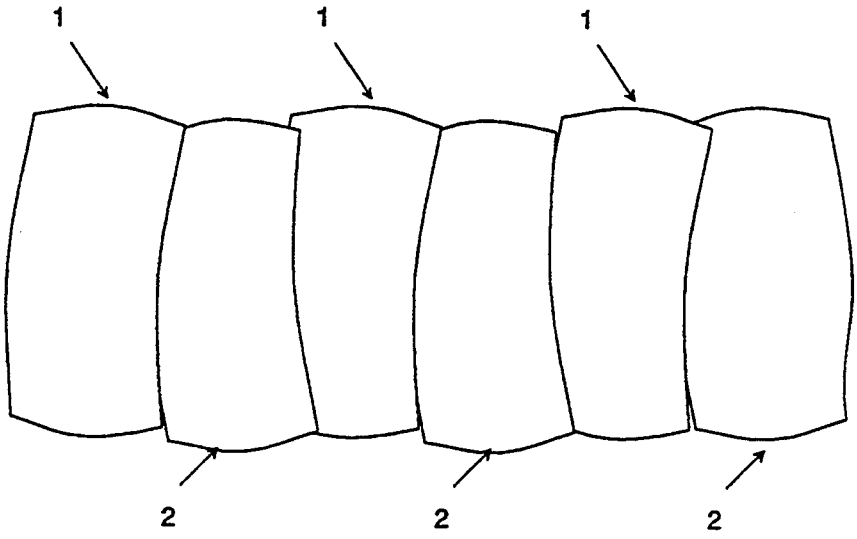
FIG. 6*a* is a top plan view of the two elongated fabric tubes interlaced and attached to any of the hair securement devices illustrated in FIGS. 2–5.
Figure 6B:
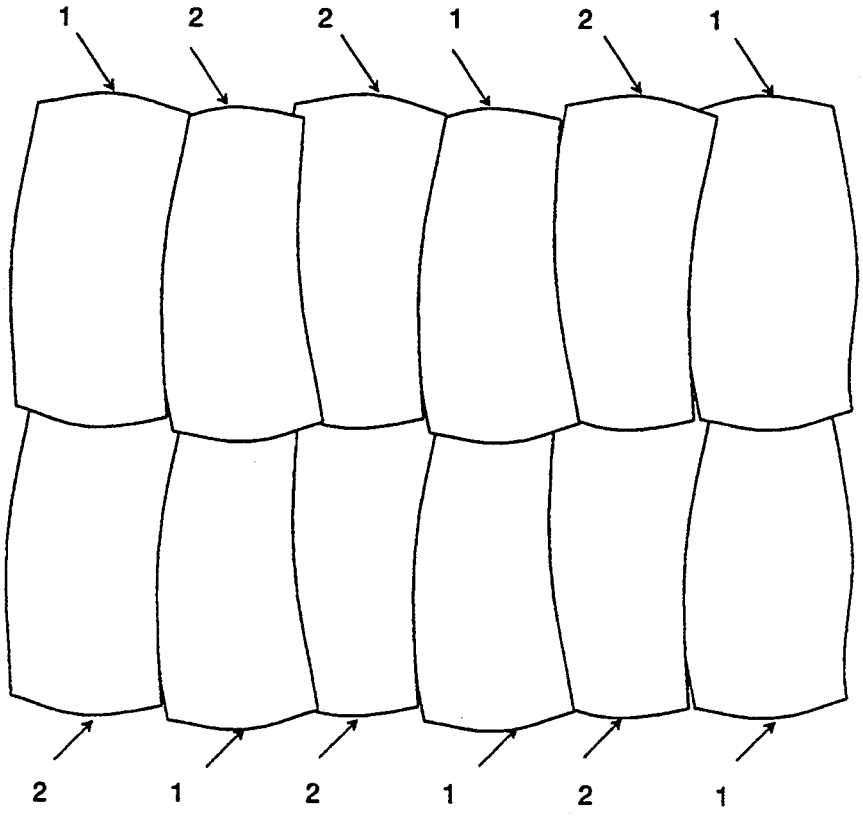
FIG. 6*b* is a top plan view of the two elongated fabric tubes interlaced and attached to the hair securement device illustrated in FIG. 4.

The top plan view of the interlaced fabric tubes is illustrated in FIG. 6*a* and 6*b*. It is seen from these figures, that elongated fabric tubes 1 and 2 alternate to form attractive hair fashion accessories.

The attachment means for all the embodiments can be accomplished by the use of adhesives, stitching, stapling, or any other means of attachment.

If the attachment means consist of adhesives, any conventional adhesives can be used such as carbohydrate-based adhesives, protein glues, elastomer-based adhesives, synthetic organic adhesives, and inorganic adhesives.

While the invention has been particularly shown and described with reference to embodiments thereof, it will be understood by those skilled in the art, that various changes in form and detail may be made without departing from the spirit and scope of the invention.

I claim:

1. A decorative hair fashion accessory comprising;
a first elongated fabric tube;
a second elongated fabric tube;
a hair securement device having a first attachment point, a second attachment point and at least two further attachment points up to an overall total of N attachment points wherein N must be at least 4; said attachment points are evenly spaced apart;
said first elongated fabric tube is secured to said hair securement device at said first attachment point and thereafter to every other attachment point up through either attachment point N if N is odd or attachment point N−1 if N is even;
said second elongated fabric tube is interlaced with said first elongated fabric tube;
said second elongated fabric tube is secured to said second attachment point and thereafter to every other attachment point up through either attachment point N if N is even or attachment point N−1 if N is odd; and
said first elongated tube and said second elongated tube are secured to said hair securement device by an attachment means.

2. The decorative hair fashion accessory as in claim 1, wherein said hair securement device is an elastic band.

3. The decorative hair fashion accessory as in claim 2, wherein said elastic band has an inner circumference and an outer circumference, said first fabric tube and said second fabric tube being attached to said outer circumference of said elastic band.

4. The decorative hair fashion accessory as in claim 3, wherein said first elastic band is attached to a barrette.

5. The decorative hair fashion accessory as in claim 1, wherein said first elongated tube and said second elongated tube is attached to a flexible comb.

6. The decorative hair fashion accessory as in claim 5 wherein said flexible comb has a top portion and said top portion has holes for said attachment means.

7. The decorative hair fashion accessory as in claim 1, wherein said attachment means is an adhesive.

8. The decorative hair fashion accessory as in claim 1, wherein said attachment means is sewing.

9. The decorative hair fashion accessory as in claim 1, wherein said attachment means is stapling.

10. A decorative hair fashion accessory comprising;
a first elongated fabric tube;
a second elongated fabric tube;
said second elongated fabric tube being interlaced with said first elongated fabric tube;
an elastic band;
said first elongated fabric tube having a first edge and a second edge;
said second elongated fabric tube having a first edge and a second edge;
said first edge and said second edge of said first elongated fabric tube being wrapped around said elastic band and being secured by an attachment means;
said first edge and said second edge of said second elongated fabric tube being wrapped around said elastic band and being secured by an attachment means; and
said first elongated fabric tube and said second fabric tube being wrapped around said elastic band one after the other.

11. The decorative hair fashion accessory as in claim 10, wherein said attachment means is an adhesive.

12. The decorative hair fashion accessory as in claim 10, wherein said attachment means is sewing.

13. The decorative hair fashion accessory as in claim 10, wherein said attachment means is stapling.

14. The decorative hair fashion accessory as in claim 10 wherein said elastic band is secured to a barrette.

* * * * *